United States Patent [19]

Evans

[11] Patent Number: 4,590,995

[45] Date of Patent: May 27, 1986

[54] RETRIEVABLE STRADDLE PACKER

[75] Inventor: Robert T. Evans, Duncan, Okla.

[73] Assignee: Halliburton Company, Duncan, Okla.

[21] Appl. No.: 716,019

[22] Filed: Mar. 26, 1985

[51] Int. Cl.[4] ..... E21B 33/124; E21B 33/129

[52] U.S. Cl. ..... 166/127; 166/128; 166/138

[58] Field of Search ..... 166/127, 128, 138, 139, 166/140, 134, 145, 147, 146, 120, 186, 191, 216

[56] References Cited

U.S. PATENT DOCUMENTS

| | | | |
|---|---|---|---|
| 1,333,390 | 3/1920 | Dickinson | 166/171 |
| 2,227,730 | 1/1941 | Lynes | 166/187 |
| 2,227,731 | 1/1941 | Lynes | 166/187 |
| 2,715,444 | 8/1955 | Fewel | 166/147 |
| 2,772,740 | 12/1956 | Edwards | 166/187 |
| 2,831,541 | 4/1958 | Conover | 166/187 |
| 2,935,133 | 5/1960 | Eckel et al. | 166/188 |
| 3,096,824 | 7/1963 | Brown | 166/138 |
| 3,122,205 | 2/1964 | Brown et al. | 166/122 |
| 3,136,364 | 6/1964 | Myers | 166/120 |
| 3,308,886 | 3/1967 | Evans | 166/138 |
| 3,329,209 | 7/1967 | Kisling, III | 166/128 |
| 3,339,637 | 9/1967 | Holden | 166/128 |
| 3,381,749 | 5/1968 | Chenoweth | 166/55 |
| 3,398,796 | 8/1968 | Fisher, Jr. et al. | 166/127 |
| 3,454,087 | 7/1969 | Pitto | 166/120 |
| 3,456,724 | 7/1969 | Brown | 166/146 |
| 3,456,725 | 7/1969 | Hatch | 166/147 |
| 3,517,743 | 6/1970 | Pumpelly et al. | 166/127 |
| 3,659,648 | 5/1972 | Cobbs | 166/120 |
| 3,714,983 | 2/1973 | Wilson | 166/120 |
| 4,279,306 | 7/1981 | Weitz | 166/312 |

FOREIGN PATENT DOCUMENTS 235230 1/1964 Austria .

OTHER PUBLICATIONS

Halliburton Services Sales and Service Catalog Number 41, pp. 4031-32 (selective injection packer).

U.S. patent application Serial No. 298,841, Luers et al., filed Sep. 3, 1981, assigned to Halliburton Company, now abandoned.

Halliburton Services Sales and Service Catalog Number 41, pp. 4013-15 (RTTS packer).

Halliburton Services Sales and Service Catalog Number 41, pp. 4019-20 (surge perforation cleaning).

Page 147, Halliburton Services Sales and Service Catalog No. 42 (1985).

*Primary Examiner*—James A. Leppink

*Assistant Examiner*—Hoang C. Dang

*Attorney, Agent, or Firm*—Joseph A. Walkowski

[57] ABSTRACT

An improved retrievable compression set straddle packer assembly for use in oil and gas wells. The straddle packer assembly comprises an hydraulic slip assembly, an injection mandrel assembly, a packer assembly, a mechanical slip assembly, a drag block assembly, and a bypass assembly.

5 Claims, 6 Drawing Figures

RETRIEVABLE STRADDLE PACKER

BACKGROUND OF THE INVENTION

This invention relates to an improved packer for oil and gas wells. More specifically, the invention relates to an improved retrievable compression set straddle packer assembly to isolate a predetermined interval of perforations in an oil or gas well casing for the selective break-down of the perforations to remove debris and produced materials therefrom or the injection of stimulation fluids into the perforations to promote the free flow of formation fluids and gases into the well bore.

The perforated section of casing set across the producing zone in an oil or gas well can be many feet, sometimes several hundred, in length. To achieve the maximum stimulation effectiveness across the entire producing zone, as many perforations as possible must be open to accept stimulation fluids. Conventional practice has been to perforate the full length of the producing interval, then stimulate the entire zone in one operation. In long perforated intervals, some of the perforations will accept stimulation fluids more readily than others. These perforations then receive all the stimulation treatment leaving portions of the producing formation unstimulated.

To ensure that the maximum number of perforations within the perforated interval are open to accept stimulation fluids, short sections of the perforated interval may be isolated with a straddle packer of this type. Hydrochloric acid or other stimulation fluids can then be injected into the perforations isolated by the two sets of packing elements to break down the perforations in this short interval. This will insure that these perforations are open to produce reservoir fluids or to accept additional stimulation fluids. The shorter the perforated interval broken down at each packer setting the more perforations within the entire producing interval will be known to be capable of accepting other stimulation fluids or to produce reservoir fluids or gases.

Typically, such injection operations have been performed using a retrievable packer having frusto-conical type cups thereon to isolate the perforations to be washed. However, such cup-type packers are susceptible to damage of the frusto-conical cups as they pass over the perforations in the casing, pass through dry casing or pass through casing liners and cannot be used with high differential fluid pressures acting across the frusto-conical cups to prevent the cups from being damaged.

Therefore, in certain instances, it is desirable to have a retrievable compression set straddle packer assembly having two sets of compression set packer elements thereon to isolate perforations in the casing in the well bore for washing.

Also, it is desirable to have such a retrievable compression set straddle packer assembly to use as a selective injection packer to isolate portions of the well bore for fluid injection operations where the length of the packer assembly between the compression set packer elements may be easily varied for use in a wide variety of well operations.

STATEMENT OF THE INVENTION

The present invention is directed to an improved retrievable compression set straddle packer assembly for use in oil and gas wells. The straddle packer assembly of the present invention comprises an hydraulic slip assembly, an injection mandrel assembly, a packer assembly, a mechanical slip assembly, a drag block assembly, and a bypass assembly.

BRIEF DESCRIPTION OF THE DRAWINGS

The advantages of the present invention will be more fully understood from the following description and accompanying drawings wherein.

DETAILED DESCRIPTION OF A PREFERRED EMBODIMENT OF THE INVENTION

Figure 1A:
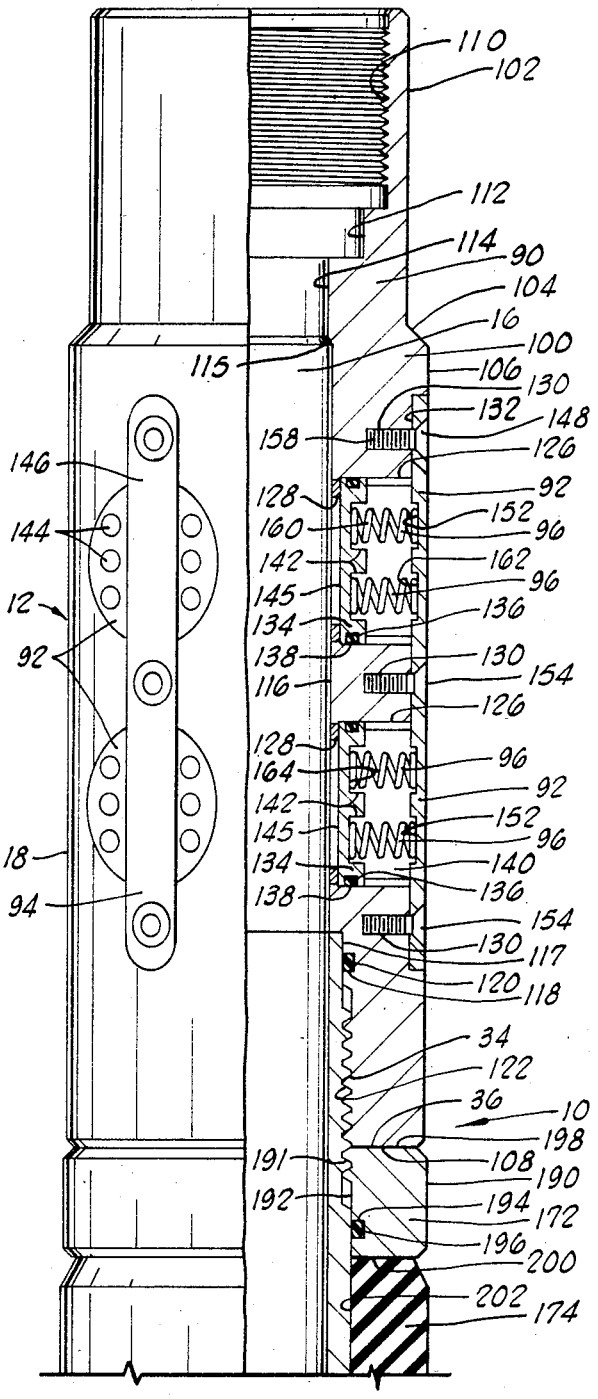
FIGS. 1A through 1D illustrate a preferred embodiment of the retrievable straddle packer assembly of the present invention in enlarged partial cross-section.

Referring now to FIGS. 1A–1D of the drawings, straddle packer assembly 10 of the present invention comprises an hydraulic slip assembly 12, an injection mandrel assembly 30, a packer assembly 170, a mechanical slip assembly 250, a drag block assembly 330, and a bypass assembly 380.

Hydraulic slip assembly 12 (to be described in greater detail below) has internal threads at the top of tool bore 16. At the lower end of hydraulic slip assembly 12 is a second threaded bore 122, above which O-ring 120 rests in annular cavity 118. O-ring 24 seals against lead surface 28 on the exterior of tubular injection mandrel 32 at the top of injection mandrel assembly 30, below which lead surface 28 external threads 34 engage second threaded bore 122 of hydraulic slip assembly 12.

A plurality of circumferential injection ports 48 extend from tool bore 16 through the wall of injection mandrel 32 opening onto seal surface 46, below which a plurality of splines 50 extend radially outwardly from the exterior of injection mandrel 32. Below splines 50, oblique annular shoulder 52 terminates in annular flat 54, below which frusto-conical slip cam surface 56 tapers inwardly back to trailing surface 58 of injection mandrel 32.

External threads 60 at the bottom of injection mandrel 32 engage threads 62 at the top of J-slot mandrel 64, O-ring 66 effecting a seal therebetween. A plurality of J-slot lugs 68 extend radially outward from cylindrical exterior surface 70 of J-slot mandrel 64, below which a plurality of circumferentially disposed bypass slots 72 extend from mandrel assembly bore 16 through the wall of J-slot mandrel 64. Immediately below bypass slots 72, annular shoulder 74, defined by upper and lower oblique surfaces 76 and 77 respectively with longitudinally extending bore wall 78 therebetween, extends radially inwardly. At the bottom of J-slot mandrel 64, external threads 80 run to the end 82 thereof. Radial vent passages 83 extend through the wall of J-slot mandrel below annular shoulder 74.

Removable plug 84, characterized by upstanding fishing neck 86 protruding from the top of plug body 88, rests on shoulder 74 of J-slot mandrel 64. Plug 84 is supported on top of oblique surface 76 by radially outwardly extending shoulder 89, and a fluid-tight seal is effected between the cylindrical exterior 91 of plug body 88 and bore wall 78 of J-slot mandrel 64 by O-rings 93 in annular grooves 96.

Injection mandrel assembly 30 includes injection mandrel 32, J-slot mandrel 64, and plug 84.

Returning to the top of retrievable straddle packer assembly 10 (see FIG. 1A) hydraulic slip assembly 12 comprises a hydraulic hold down body 90, a plurality of hydraulic slips 92 retained within body 90, a plurality of hydraulic hold down straps 94 retaining the plurality of hydraulic slips 92 within body 90 and a plurality of hydraulic slip retractor springs 96 biasing the plurality of slips 92 in a retracted position within body 90.

The hydraulic hold down body 90 comprises an annular elongated cylindrical member 100 having, on the exterior thereof, a first cylindrical portion 102, first annular chamfered shoulder 104, second cylindrical portion 106, and radially flat lower face 108 and, on the interior thereof, first threaded bore 110, first annular shoulder 112, first cylindrical bore 114, oblique annular shoulder 115, second cylindrical bore 116, and third cylindrical bore 117, having annular cavity 118 therein containing O-ring 120, and second threaded bore 122 (see FIG. 1A).

The hydraulic hold down body 90 further includes a plurality of first bores 126 and second bores 128 having, in turn, a diameter smaller than first bores 126 extending through the body 90 from the second cylindrical portion 106 on the exterior of the body 90 to the second cylindrical bore 116 on the interior thereof, a plurality of threaded apertures 130 extending partially through body 90 extending inwardly from second cylindrical portion 106 of body 90, and a plurality of elongated recesses 132 in second cylindrical portion 106 of body 90, a portion of each elongated recess 132 extending over each first bore 126 in the body 90.

Retained within each first bore 126 in the hydraulic hold down body 90 is a cylindrical hydraulic slip 92. The hydraulic slip 92 comprises a cylindrical member 134 having an annular recess 136 in the exterior thereof having, in turn, annular elastomeric seal 138 therein, an elongated slot 140 extending through a portion thereof, a plurality of recesses 142 therein, and a plurality of teeth 144 thereon. The bottom 145 of each hydraulic slip 92 is in fluid communication with the second cylindrical bore 116 of hydraulic hold down body 30 via second bore 128 in the body 90.

Each hydraulic hold down strap 94 comprises an elongated, generally rectangular in cross-section member 146 having a width such that the member 146 readily is received within elongated recess 132 in hydraulic hold down body 90 and such that the elongated slot 140 in each slip 92 is wider than the width of member 146, having a plurality of bores 148 extending therethrough and having a plurality of circular recesses 152 therein. Each hydraulic hold down strap 94 is releasably secured to hydraulic hold down body 90 by a plurality of threaded fasteners 154, each fastener 154 having the threaded body 158 thereof extending through a bore 148 of strap 94 threadedly engaging threaded aperture 130 in body 90.

The hydraulic slip retractor springs 96 each comprise a coil wound type spring member 160 having one end 162 thereof retained within circular recess 152 of hydraulic hold down strap 94 and the other end 164 thereof received within recess 142 in hydraulic slip 92.

The hydraulic slip retractor springs 96 resiliently bias hydraulic slips 92 within first bores 126 within hydraulic hold down body 90.

Figure 1B:
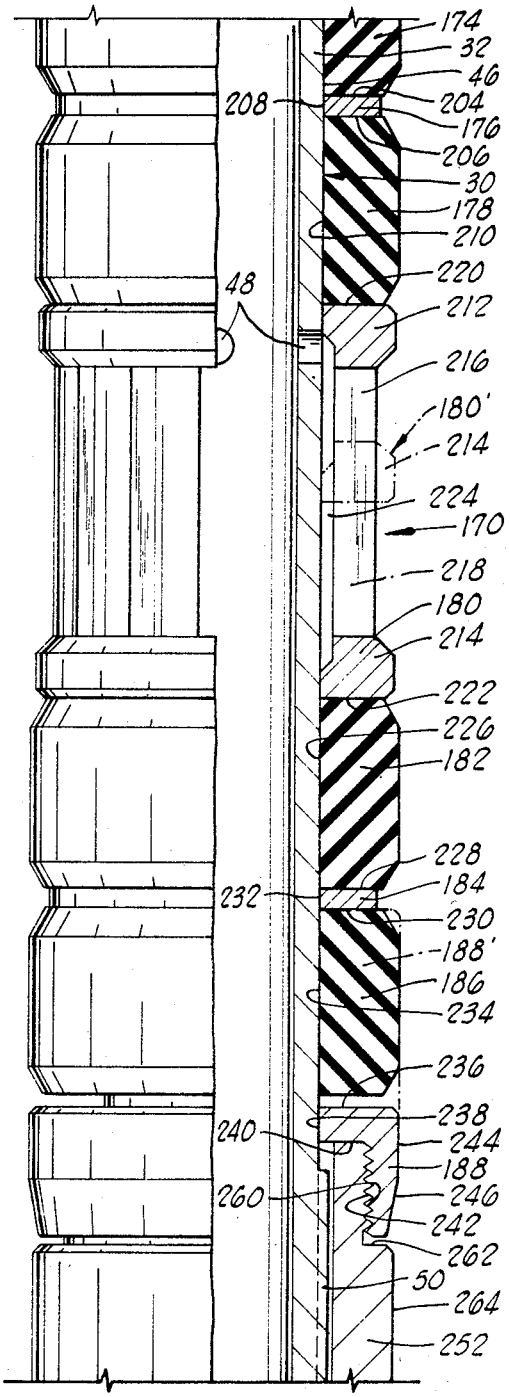
Figure 1C:
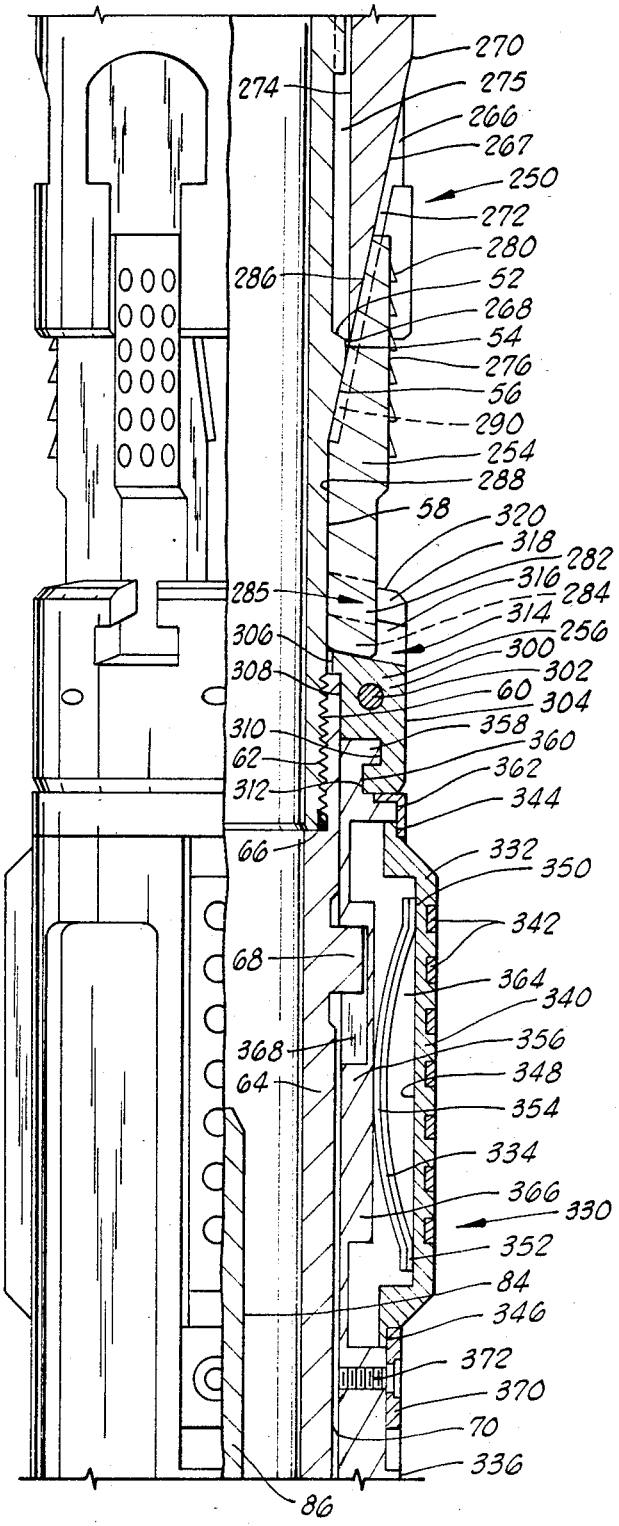
Figure 1D:
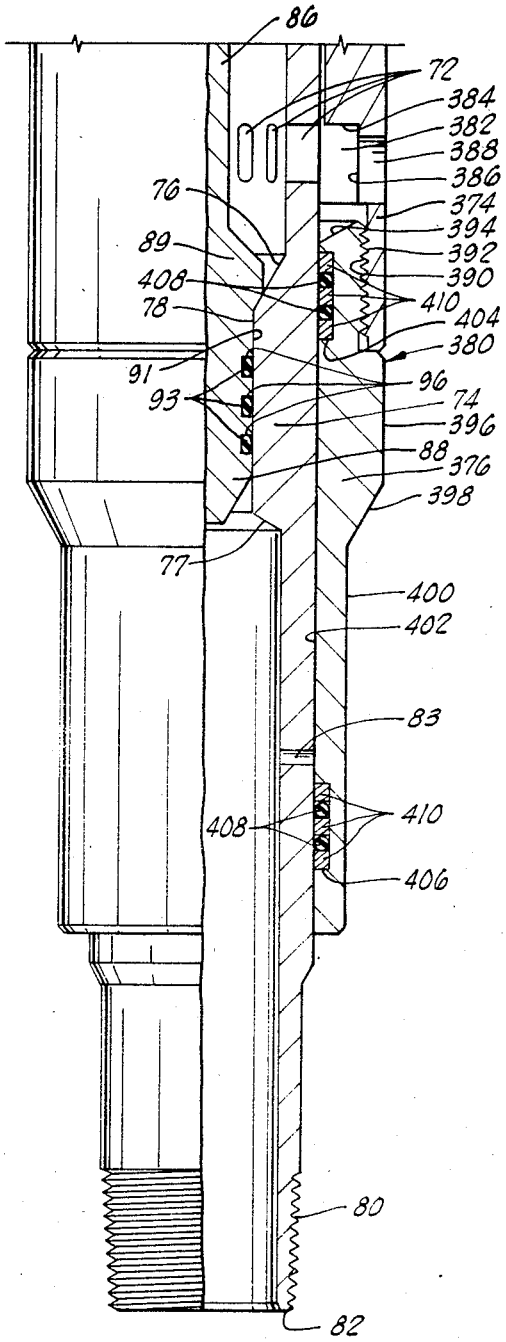

Referring to FIGS. 1A and 1B, the packer assembly 170 comprises an upper shoe 172, a first upper packer element 174, spacer ring 176, a second upper packer element 178, injection spacer 180, a first lower packer element 182, spacer ring 184, a second lower packer element 186, and a lower shoe 188.

Upper shoe 172 comprises an annular member having a cylindrical exterior 190, a threaded bore 191 and a cylindrical bore 192 therebelow having annular recess 194 therein, within which rests elastomeric O-ring 196 therein. Upper shoe 172 also includes upper and lower radially flat faces 198 and 200, respectively. O-ring 196 sealingly engages the exterior 46 of injection mandrel 32, while threaded bore 191 engages external threads 34 of injection mandrel 30.

First upper packer element 174 comprises an annular elastomeric member having cylindrical bore 202 therethrough.

Spacer ring 176 comprises a washer-like annular member having an upper surface 204, a lower surface 206, and bore 208 therethrough.

Second upper packer element 178 comprises an annular elastomeric member having a cylindrical bore 210 therethrough.

Injection spacer 180 comprises upper and lower packer compression rings 212 and 214, respectively, separated by a plurality of injection struts 216 having a plurality of slots 218 therebetween. Ring 212 has a radially flat upper face 220, and ring 214 has a radially flat lower face 222. The interior of injection spacer 180 defines a shallow annular cavity 224 between struts 216 and the exterior 46 of injection mandrel 32. The exterior of injection spacer 180 is recessed adjacent struts 216, rings 212 and 214 extending radially therebeyond.

First lower packer element 182 comprises an annular elastomeric member having cylindrical bore 226 therethrough.

Spacer ring 184 comprises a washer-like annular member having upper and lower radially flat surfaces 228 and 230, and bore 232 therethrough.

Second lower packer element 186 comprises an annular elastomeric member having cylindrical bore 234 therethrough. Lower shoe 188 includes a radially flat upper face 236, a first cylindrical bore 238, a radially flat interior lower face 240 and a threaded interior bore 242. The exterior of lower shoe 188 includes a first cylindrical surface 244 leading to inwardly tapering annular surface 246.

Mechanical slip assembly 250 includes slip body 252, a plurality of slips 254, and a split ring collar assembly 256. The left-hand side of FIG. 1C in the vicinity of slip assembly 250 has been rotated slightly to the left for a clearer view of the exterior thereof.

Slip body 252 includes threaded exterior lead surface 260 which engages threaded bore 242 of lower shoe 188, annular shoulder 262 and cylindrical exterior surface 264 having a plurality of wedge shaped recesses 266 therein having slip wedge surfaces 267, each recess 266 extending from the lower end 268 of slip body 252 to an intermediate position 270 on the exterior 264 thereof. Recesses 266 include laterally extending channels 272 at either side thereof. The interior of slip body 252 comprises cylindrical bore 274, having lugs 275 extending radially inwardly therefrom, engaged with splines 50 of injection mandrel 32.

Each slip 254 comprises an elongated member of generally rectangular cross-sectional shape throughout its upper extent, which possesses an arcuate exterior surface 276 having a plurality of wedge shaped gripping members 280 protruding therefrom. The mid-portion of each slip 254 comprises a neck member 282 defined by recesses at either side thereof, terminating at the bottom of slip 254 with laterally extending projections 284, forming therewith a T-shaped lug 285. The upper interior of each slip 254 comprises oblique surface 286 which rides on slip wedge surface 267 of recess 266, while the lower interior of each slip 254 comprises an arcuate surface 288. Lateral webs 290 extend from either side of oblique surface 286 and are received in channels 272 in slip body 252.

Split ring collar assembly 256 comprises a plurality of arcuate shaped collar members 300 secured to each other and forming an annular assembly by means of a plurality of threaded fasteners 302. Each collar member 300 includes an arcuate outer surface 304, first arcuate inner surface 306, second arcuate inner surface 308, third arcuate inner surface 310, and fourth arcuate inner surface 312. Each collar member 300 further includes a T-shaped recess 314 therein defined by lateral channels 316 and longitudinal channel 318 extending thereto from the upper end 320 of each member 300. Each recess 314 receives a T-shaped lug 285 of a slip 254 therein.

Drag block assembly 330 includes a plurality of drag blocks 332, drag block springs 334 and a drag block sleeve 336.

Drag blocks 332 each comprise a longitudinally extending member 340 having carbide buttons 342 disposed on the radially exterior surface thereof. At the upper and lower extents of member 340 lips 344 and 346 extend therefrom. Longitudinal slot 348 is cut into the interior of member 340, receiving the ends 350 and 352 of drag block spring 334.

Figure 2:
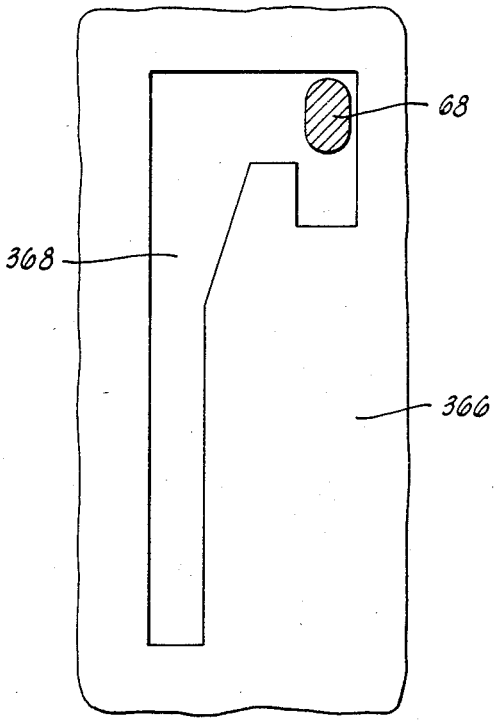
FIG. 2 is a development of the J-slot employed in the drag block sleeve in the present invention.

Drag block sleeve 336 comprises a cylindrical body 356 having radially extending annular shoulder 358 above circumferential channel 360 at its upper end, which structure engages the lower end of split ring collar assembly 256. Tabs 362 are welded onto body 356 and extend over upper lips 344 of drag blocks 332. In the center of body 356 is a cavity 364 into which drag blocks 332 may be biased against drag block springs 334, the center 354 of each drag block spring 334 bearing against the top of J-slot housing 366, which contains J-slots 368 cut into the inside thereof, into which J-slot lugs 68 from J-slot mandrel 64 radially extend. A development of J-slots 368 is shown in FIG. 2 of the drawings. Lower lips 346 of drag blocks 332 are maintained in drag block sleeve by tabs 370 which are secured to body 356 by bolts 372.

The lower end 374 of drag block sleeve 336, in conjunction with bypass seal body 376, and the lower end of J-slot mandrel 64 comprises bypass assembly 380. Drag block sleeve 336 is undercut at its lower end to form an annular recess 382, defined by radial flat 384 and interior bore wall 386. Bypass ports 388 extend through the wall of sleeve 336, opening into recess 382. Below recess 382, threaded bore 390 extends to the lower end of sleeve 336. Bypass seal body 376 has threaded leading end 392 on its upper exterior, which engages threaded bore 390, leading surface 394 defining the lower extent of recess 382. The exterior of bypass seal body 376 comprises a first cylindrical surface 396, a frusto-conical inwardly extending surface 398, and a second cylindrical trailing surface 400. The interior of bypass seal body comprises a cylindrical bore 402 having two shallow annular recesses 404 and 406 therein, each such recess holding a plurality of O-ring seals 408 supported by teflon backup rings 410, which seals bear sealingly against the exterior 70 of J-slot mandrel 64.

OPERATION OF A PREFERRED EMBODIMENT OF THE INVENTION

Referring to drawing FIGS. 1–3, the operation of the preferred embodiment 10 of the straddle packer assembly of the present invention is as follows.

The hydraulic hold down body 90 of the hydraulic slip assembly 12 is connected to the bottom of a tubing string 500 to be run into well bore 502 from rig 504.

When the straddle packer assembly 10 is run into well bore 502, the drag block assembly 380 of the packer assembly 10 slidingly, resiliently engages the well bore casing 506. To set the straddle packer assembly 10 in the well bore, the tubing string 500 is rotated to the right and right hand torque is maintained on the tubing string 500. This causes the lugs 68 on J-slot mandrel 64 to move from the short portion of the J-slots 368 to the long portion of the J-slots 368, lugs 68 having been moved from the bottom of the short portion of the J-slots 368 to the top thereof (see FIG. 2) by the relative movement of the drag block assembly 330 with respect to the J-slot mandrel 64 as the packer assembly 10 is run into the well bore by means of the drag blocks 332 of drag block assembly 330 engaging the well bore casing 506. Next, while holding right hand torque on the tubing string, the tubing string is lowered or "slacked off" until the slips 254 of mechanical slip assembly 250 begin to take weight off the tubing string. During this operation, the lugs 68 on J-slot mandrel 64 move downwardly in the long portion of the J-slots 368 in drag block sleeve 336, causing frusto-conical slip cam surface 56 of injection mandrel 32 to cam the slips 254 into engagement with well bore casing 506. At this time, the right hand torque may be released with continued movement of the tubing string 500 downwardly in well bore 502 until the desired amount of weight is set on the packer assembly 10.

As the packer assembly 10 picks up weight from the tubing string 500 the downward movement of the hydraulic hold down body 90, injection mandrel 32 and J-slot mandrel 64 with respect to the stationary slips 254 and slip body 252 cause the upper and lower packer elements 174, 178 and 182, 186 respectively, to be compressed into engagement with the well bore casing 506 while bypass slots 72 on the J-slot mandrel 64 move downwardly past the upper set of O-rings 408 in bypass seal body 376, closing bypass assembly 380.

After the retrievable straddle packer assembly 10 is set in the well bore 502, the portion of the well bore located between upper packer elements 174 and 178 and the lower packer elements 182 and 186 is isolated. If it is desired to treat perforations 510 adjacent this isolated portion 508 of the well bore 502, the portion of the well bore located between upper packer elements 174 and 178 and the lower packer elements 182 and 186 is isolated. If it is desired to treat perforations 510 adjacent this isolated portion 508 of the well bore 502, treating fluid may be pumped down the tubing string 502, through hydraulic hold down body 90 of the upper hydraulic slip assembly 12, and injection mandrel 32 through injection ports 48 in injection mandrel 32 and slots 218 in injection spacer 180, into isolated well bore 508 and into perforations 510.

When treating fluid is pumped through upper hydraulic slip assembly 12, the hydraulic slips 92 are forced into engagement with the well bore by the pressure of the treating fluid acting on the bottom 145 of each slip 92. When the slips 92 engage the well bore casing 506, this in conjunction with slips 254 engaging the well bore casing 506 helps prevent movement of the straddle packer assembly 10 in the well bore in either direction. Upon the cessation of the pressure of the treating fluid acting upon the bottom 145 of the hydraulic slips 92, the slips disengage the well bore by hydraulic slip retractor springs 96 biasing the slips 92 into a retracted position within the body 90.

When finished treating the isolated portion 508 of the well bore 502, to retrieve the packer assembly 10, weight is picked up from the packer assembly 10 by tubing string 500 thereby allowing the various components of packer assembly 10 to return to their positions shown in drawing FIGS. 1A–1D with hydraulic slips 92, upper and lower packer element 174, 178 and 182, 186 respectively and mechanical slips 254 disengaging the well bore casing 506 to allow the movement of the packer ssembly 10 in the well bore 502 to isolate another area for treatment or to retrieve packer assembly 10.

When the packer assembly 10 is moved upwardly, bypass slots 72 in J-slot mandrel 64 move upwardly into communication with recess 382, allowing fluid comunication between the exterior and interior of the bypass assembly 380 of the packer assembly 10 through ports 388, recess 382, slots 72, tool bore 16 and injection ports 48 to equalize pressure on either side of the lower packer elements 182 and 186 to prevent damage hereto when retrieving the packer assembly. If the luid pressure is not equalized across lower packer elements 182 and 186 prior to moving the packer assembly 10, any higher fluid pressure above the packer elements 182 and 186 than therebelow will tend to cause them to remain engaged with the well bore casing 506 thereby causing them damage upon any movement of the packer assembly 10.

Figure 3:
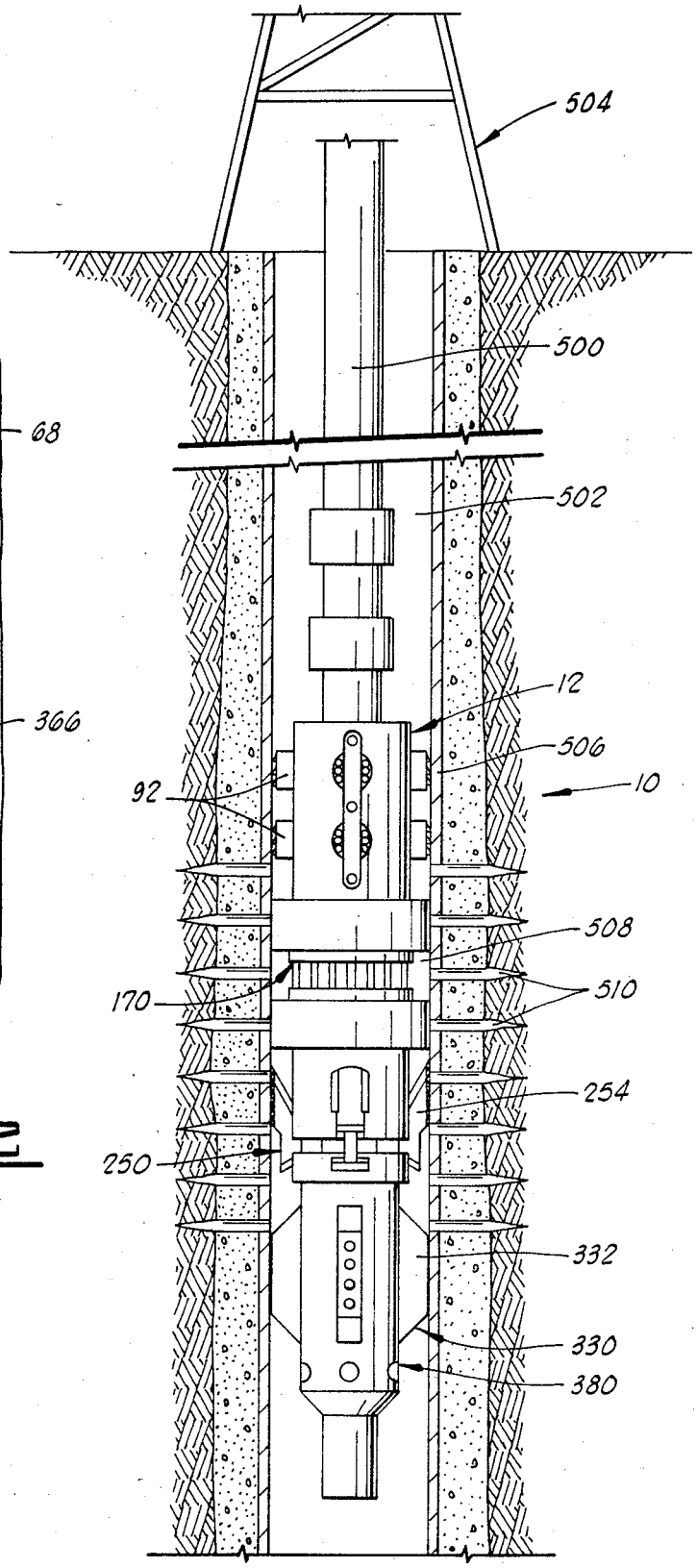
FIG. 3 is a schematic view of the retrievable straddle packer assembly of the present invention deployed in a cased well bore having perforations therethrough.

If it is desired to move packer assembly 10 downward in well bore 502 from the position shown in FIG. 3, tubing string 500 is picked up, rotated to the left, and set back down to lock J-slot lugs 58 in the short portion of J-slots 368, to prevent slips 254 from engaging well bore casing 406. Normally, in order to avoid rotation of the tubing string 500, the lowermost interval 508 having perforations 510 will be treated first, and packer assembly 10 moved progressively upward in the well bore 502. Such an operation only requires picking up and setting down tubing string 500.

Generally, injection ring 180 may be sized so as to provide a six-inch spacing between upper packer element 178 and lower packer element 182, whereby two perforations 510 in casing 506 may be treated or broken down at a time, such perforations generally being made at three-inch intervals. However, if it is desired to treat a single perforation or several at a single level in the well bore 502 (see FIG. 3), injection spacer 180 may be replaced with a shorter three-inch spacer ring 180' (see FIG. 1B) and lower shoe 188 may be replaced with a longer, upward-extending lower shoe 188' (see FIG. 1B) three inches greater in length, thereby shifting lower packer elements 182 and 186 upwardly on injection mandrel 32. In similar fashion, if a longer interval of perforated casing is to be treated, a longer injection spacer may be substituted with a longer injection mandrel having appropriately spaced injection ports.

Thus it is apparent that a novel and unobvious compression set straddle packer assembly has been invented. It will be obvious to those of ordinary skill in the art that modifications, additions, deletions and other changes may be made to the present invention which fall within the scope thereof and, as such, are intended to be encompassed therewithin.

I claim:

1. A retrievable straddle packer for use in wells, comprising:

an hydraulic slip assembly;

a tubular injection mandrel assembly secured to said hydraulic slip assembly and extending downardly therefrom, said mandrel assembly having a plurality of injection ports extending through the wall thereof and a plurality of bypass slots extending through the wall thereof below said injection ports;

upper packer element means disposed on said mandrel assembly adjacent to said hydraulic slip assembly;

injection spacer means disposed on said mandrel assembly adjacent to and below said upper element means, said injection spacer means including upper and lower packer compression rings separated by a plurality of longitudinal struts defining a plurality of apertures therebetween;

lower packer element means disposed on said mandrel assembly adjacent to and below said injection spacer means;

a slip body disposed on and splined to said mandrel assembly below said lower packer element means;

a plurality of slips disposed on said mandrel assembly, the upper ends of said slips being longitudinally slidably secured to said slip body and the lower ends of said slips being radially slidably secured to a split ring collar assembly therebelow surrounding said mandrel assembly;

a drag block assembly disposed on said mandrel assembly below said split ring collar assembly and secured thereto;

J-slot means comprising lug means asociated with one of said mandrel assembly and said drag block means, and a cooperating J-slot associated with the other of said mandrel assembly and said drag block means; and a bypass assembly disposed on said mandrel assembly below said drag block means and secured thereto, said bypass assembly including bypass ports through the wall thereof adapted to communicate with said bypass slots of said mandrel assembly when aligned therewith.

2. The retrievable straddle packer of claim 1 wherein the hydraulic slip assembly comprises:

an hydraulic hold down body having a plurality of apertures therein and a bore therethrough;

a plurality of hydraulic slips located in the plurality of apertures in the hydraulic hold down body, each slip having an elongated slot extending through a portion thereof;

a plurality of hold down straps overlying the plurality of hydraulic slips, each strap overlying the elongated slot in at least one hydraulic slip and being secured to the hold down body; and a plurality of hydraulic slip retractor springs, each spring having one end abutting a hold down strap and the other end abutting a portion of a hydraulic slip.

3. The retrievable straddle packer of claim 1 wherein said injection mandrel assembly comprises:

a tubular injection mandrel having said injection ports through the wall thereof;

a tubular J-slot mandrel having lug means protruding radially therefrom and bypass slots through the wall thereof; and a plug in the bore of said J-slot mandrel below said bypass slots.

4. The retrievable staddle packer of claim 3 wherein the drag block assembly comprises:

a drag block sleeve having a plurality of recesses therein and a bore therethrough;

a plurality of drag blocks, each block located in a recess in the drag block sleeve;

a plurality of drag block springs, each spring having a portion thereof engaging a portion of each drag block and a portion of the drag block sleeve;

a J-slot housing means in said drag block sleeve; and bypass ports extending between the interior and exterior of said drag block sleeve.

5. The retrievable straddle packer of claim 4 wherein the bypass assembly comprises said drag block sleeve and said J-slot mandrel, said bypass ports in said drag block sleeve and said bypass slots in said J-slot mandrel providing a bypass passage between the bore of said injection mandrel assembly and the exterior of said straddle packer.

* * * * *